US006046542A

United States Patent [19]

Silva et al.

[11] Patent Number: 6,046,542

[45] Date of Patent: Apr. 4, 2000

[54] ELECTRON DEVICES COMPRISING A THIN-FILM ELECTRON EMITTER

[75] Inventors: Sembukuttiarachilage R. P. Silva, Woking; John M. Shannon, Whyteleaf, both of United Kingdom

[73] Assignee: U.S. Philips Corporation, New York, N.Y.

[21] Appl. No.: 08/904,389

[22] Filed: Aug. 1, 1997

[30] Foreign Application Priority Data

Aug. 2, 1996 [GB] United Kingdom ..... 9616265

[51] Int. Cl.[7] ..... H01J 9/12

[52] U.S. Cl. ..... 313/497; 313/495; 313/310

[58] Field of Search ..... 313/495, 496, 313/497, 309, 310, 336, 351; 257/10, 11

[56] References Cited

U.S. PATENT DOCUMENTS

| | | | |
|---|---|---|---|
| 4,303,930 | 12/1981 | Van Gorkom et al. | 357/13 |
| 4,516,146 | 5/1985 | Shannon et al. | 357/52 |
| 5,090,932 | 2/1992 | Dieumegard et al. | 445/24 |
| 5,483,263 | 1/1996 | Bird et al. | 345/207 |
| 5,541,478 | 7/1996 | Troxell et al. | 313/497 |

FOREIGN PATENT DOCUMENTS

| | | | |
|---|---|---|---|
| 0532019 A1 | 3/1993 | European Pat. Off. | H01J 1/30 |
| 07006687 | 1/1995 | Japan | H01J 1/30 |

OTHER PUBLICATIONS

Electronics Letters, Aug. 1991, vol. 27, No. 16, pp. 1459–1460.

"Diamond Cold Cathodes" by M.W. Geis et al, Applications of Diamond Films and Related Materials, Edited Tzend et al, Elsevier Science Publishers 1991.

Experiments of Highly Emissive Metal–Oxide–Semiconductor Electron Tunneling Cathode by Yokoo et al in J. Vac. Sci, Technol. B 14(3) May/Jun. 1996 pp. 2096–2099.

"Amorphous–Silicon–on–Glass Field Emitter Arrays" by Gamo et al IEEE Electron Device Letters vol. 17, No. 6, Jun. 1996 pp. 261–263.

Nitrogen Containing Gydrogenatee Amorphous Carbon for Thin–film Field Emission Cathodes, by Gehan A.J. Amaratunga, in Appl. Phys. Lett. 68(18), Apr. 29, 1996 pp. 2529–2531.

Current–Induced Defect Conductivity in Hydrogeneted Silicon–Rich Amorphous Silicon Nitride: by Shannon et al, Philosophical Magazine Letter 1995, vol. 72, No. 5, pp. 323–329.

*Primary Examiner*—Sandra O'Shea
*Assistant Examiner*—Matthew J. Gerike
*Attorney, Agent, or Firm*—John C. Fox

[57] ABSTRACT

In a flat panel display or other type of electron device, a thin-film electron emitter (51) and/or emitter array (50) is formed in a semiconductor film (10) of, for example, hydrogenated amorphous and/or microcrystalline Si, $SiC_x$, $SiN_y$, $SiO_xN_y$ or the like. An injector electrode (14) forms a potential barrier ($\phi_B$) with the semiconductor film (10) at a back major surface (12) of the film (10). A front electrode (15) serves for biasing an emission area (11*a*) of the front major surface (11) at a sufficiently positive potential ($V_{15}$) with respect to the injector electrode (14) as to inject electrons (e) over the barrier ($\phi_B$) in the operation of the emitter (51) while controlling the magnitude of an electron accumulation layer (Ne) in the semiconductor film (10) at the emission area (11*a*). Under this bias condition the semiconductor film (10) supports a depletion layer from the injector electrode (14) to the electron accumulation layer (Ne), so establishing a field in which the electrons are heated and directed towards the emission area (11*a*). The electron emission area is a plane surface area (11*a*) free of the front electrode (15), to which it may be connected directly or by a gateable connection (G,29). Some of the electrons from the injector electrode (14) are emitted at the emission area (11*a*), while others heat electrons in the accumulation layer (Ne) to stimulate their emission. The front electrode (15) extracts excess electrons not emitted from the emission area (11*a*). The emitter (51) is well suited for fabrication with thin-film silicon-based technology.

10 Claims, 4 Drawing Sheets

ELECTRON DEVICES COMPRISING A THIN-FILM ELECTRON EMITTER

BACKGROUND OF THE INVENTION

This invention relates to electron devices comprising a thin-film electron emitter formed with a semiconductor film, particularly but not exclusively of a silicon material such as hydrogenated amorphous and/or microcrystalline $SiC_x$ or $SiN_y$ or $SiO_xN_y$ or Si. Preferably a thin-film array of such electron emitters are formed side-by-side in the semiconductor film. The electron device may be, for example, a flat panel display.

The paper "Experiments of highly emissive metal-oxide-semiconductor electron tunnelling cathode" by Yokoo et al in J. Vac. Sci. Technol. B 14(3), May/June 1996 pp 2096–2099 discloses a thin-film electron emitter comprising an insulating oxide film through which electrons tunnel from an n-type substrate into a gate which provides an emission area from which the electrons are emitted. The gate comprises an aluminium gate electrode on a n-type doped silicon semiconductor film on a 20–30 nm thick non-doped silicon semiconductor film on the oxide insulating film. The thickness of the 20–30 nm thick non-doped silicon semiconductor film is such as to support a depletion layer which establishes an accelerating field for the electrons from the oxide film to the emission area with lower scattering probability than in the oxide film, so increasing the emission efficiency. The whole contents of this J. Vac. Sci. Technol. paper are hereby incorporated herein as reference material.

The paper "Amorphous-Silicon-on-Glass Field Emitter Arrays" by Gamo et al in IEEE Electron Device Letters Vol 17, No 6, June 1996 pp 261–263 describes a thin-film array of electron emitters formed side-by-side in a semiconductor film, an electron source at the back face of the semiconductor film for supplying electrons to the semiconductor film, and an array of emission areas at the front of the semiconductor film from which electrons are emitted in operation of the device. The semiconductor film of 1 $\mu$m thick amorphous silicon is sputter deposited on a bottom contact and divided up into separate conical emitters at windows in an insulating film on the device substrate. This insulating film carries an apertured gate, which is thereby insulated from the underlying bottom contact. The tip of the cone forms the emission area of the emitter, and the emission characteristics are dependent on the quality of the tip, which is not easy to control during manufacture. These emitters require a high gate voltage for operation. The whole contents of this IEEE Electron Device Letters paper are hereby incorporated herein as reference material.

The paper "Nitrogen containing Hydrogenated amorphous Carbon for Thin-film field emission Cathodes" by Amaratunga and Silva, published in Applied Physics Letters Vol.68 No.18, Apr. 29, 1996, pages 2529 to 2531 describes a thin-film electron emitter formed in a semiconductor film (of 0.3 $\mu$m thick amorphous carbon). The emitter comprises a highly doped n-type silicon substrate forming the cathode electrode at a back major surface of the semiconductor film, and an oppositely located emission area at the front major surface of the semiconductor film from which electrons are emitted in operation of the device. Uniform emission of electrons over the entire front major surface of the carbon film was observed at low current densities (below $7\times10^{-2}$ $mA.cm^{-2}$). At higher current densities preferential emission from uncontrolled spots was observed. It is suggested that, by adopting a triode configuration, the emitter may be suitable for switching a display element. The fabrication of a thin film array of emitters is not described in any configuration. The whole contents of the Applied Physics Letters paper are hereby incorporated herein as reference material.

OBJECTS AND SUMMARY OF THE INVENTION

It is an aim of the present invention to improve the electron emission efficiency from an emission area at a major surface of a semiconductor film and to provide an emitter arrangement facilitating the control of the emission and also facilitating fabrication of a thin-film array of such emitters side-by-side in the semiconductor film.

It is a further aim of the present invention to provide an emitter structure which is well suited to fabrication using thin-film silicon-based technologies.

In accordance with the present invention there is provided an electron device including a thin-film electron emitter comprising a semiconductor film, the emitter having an emission area comprising a plane area of a front major surface of the semiconductor film from which hot electrons are emitted in operation of the emitter, an injector electrode at a back major surface of the semiconductor film from which electrons are injected into the semiconductor film, electron-accumulation means for providing an accumulation layer of electrons at the emission area of the semiconductor film, and a front electrode located beside the emission area and electrically connected laterally to the electron accumulation layer to determine the surface potential at the emission area for controlling the magnitude of electron accumulation at the emission area and for extracting excess electrons not emitted from the emission area, the emission area being free of the front electrode, and the semiconductor film having such a thickness as to support a depletion layer from the injector electrode to the electron accumulation layer when the emission area is biased by the front electrode sufficiently positively with respect to the injector electrode for injecting the electrons from the injector electrode into the semiconductor film in operation of the emitter, the depletion layer establishing from the injector electrode to the emission area an electric field in which the electrons are heated and directed towards the emission area.

The present invention is based on a recognition by the present inventors that the emission efficiency from a plane surface area of a semiconductor film can be improved and controlled by providing a laterally-connected front electrode for biasing the emission area with respect to the injector electrode, by providing a well-defined electrode barrier with the semiconductor film at its back major surface for the injection electrode, and by depleting the film across its thickness from the injector electrode to the electron accumulation layer at the emission area free of the front electrode, so as to control the injection of the electrons into the semiconductor film and to provide a field which heats and directs the electrons towards the accumulation layer the front major surface. The front electrode (which is electrically connected to the emission area without obscuring the emission area) controls band-bending in the semiconductor film, and so can determine the surface potential at the emission area, control the number of electrons in the accumulation layer, and extract excess electrons not emitted from the emission area. By controlling the surface potential at the emission area and by extracting excess electrons not emitted from the emission area, the front electrode can control the electron population of an accumulation layer at the major surface under the influence of an anode potential in the device. The electrons in this electron accumulation layer can be heated by hot electrons arriving at this major surface from the oppositely-located injector electrode, the degree of excitation being sufficient for emission from the surface. A sufficient supply of hot electrons for this excitation is provided by means of the field which is established through the depletion layer across the low-doped semiconductor film from the injector electrode to the emission area.

The front electrode may be in electrical contact with the perimeter of the emission area so as to be connected directly to an edge of the electron accumulation layer. The emitter may then be switched on and off by changing the potential of the front electrode. In another form, the lateral connection of the front electrode to the emission area may be in the form of an insulated gate provided on the semiconductor film between the front electrode and the emission area so as to gate the electrical connection between the front electrode and the electron accumulation layer. In this case, the emitter can then be switched on and off by changing the potential of this intermediate gate to open and close the lateral connection to the front electrode. This gated connection structure resembles a thin-film transistor (TFT), and well-established silicon thin-film TFT technology can be used to fabricate the electron emitter when the semiconductor film is of silicon. Electron emission efficiencies achievable in accordance with the present invention are well suited to emitter fabrication with well-established silicon thin-film TFT technologies, as described hereinafter.

Electron emitter structures in accordance with the present invention are well suited for integration in arrays. The array may be organised as a two-dimensional matrix on a substrate. In this case, a plurality of thin-film metal tracks may extend along one direction on the substrate to form the injector electrodes of the emitters, and a plurality of conductive tracks may extend along the front major surface of the semiconductor film and transverse to the one direction to form connections for the front electrodes of the emitters.

The present invention is well suited to the fabrication of electron emitters with semiconductor films of thin-film silicon material, for example hydrogenated amorphous and/or microcrystalline silicon or silicon-compound material from the group of $SiC_x$, $SiN_y$ and $SiCOxN_y$. Silicon-based thin-film technology is well established and its parameters are well understood in the industry. Silicon itself has a convenient energy bandgap for forming good injector barriers with various often-used thin-film electrode materials, such as for example chromium, and also for forming good ohmic contacts via doped regions for the front electrode. Thus, for example, the front electrode may easily be formed as an n-type doped semiconductor region in and/or on an area of the semiconductor film beside the emission area. Silicon-based thin-film technology has also an established understanding of how the bandgap and the characteristics of barriers and contacts can be tailored by controlling the composition of a non-stoichiometric silicon-based compound and/or alloy, for example amorphous hydrogenated $SiC_x$, $SiN_y$ and $SiCO_xN_y$. Furthermore, such thin-film silicon materials have proved to have a low electron affinity, so aiding electron emission.

The electron-accumulation means may include an n-type doped semiconductor region in the semiconductor film at the emission area. Such electronic doping can be readily controlled in a semiconductor film material such as silicon. Moderately high n-type doping concentrations may be used so as to avoid high lateral resistance along the electron extraction path in the accumulation layer. Additionally and/or alternatively, a positive bias on an anode of the electron device may provide the electron-accumulation means which induces accumulation of electrons at the emission surface area of the film facing the anode across, for example, a vacuum gap.

Preferably the front electrode extends around at least most of the perimeter of the emission area, thereby providing better uniformity for the surface potential of the emission area. This feature is particularly (but not solely) beneficial when the electron accumulation layer does not comprise a moderately high doping.

BRIEF DESCRIPTION OF THE DRAWINGS

These and other features of the present invention, and their advantages, are illustrated specifically in embodiments of the invention now to be described, by way of example, with reference to the accompanying drawings in which.

Figure 1:
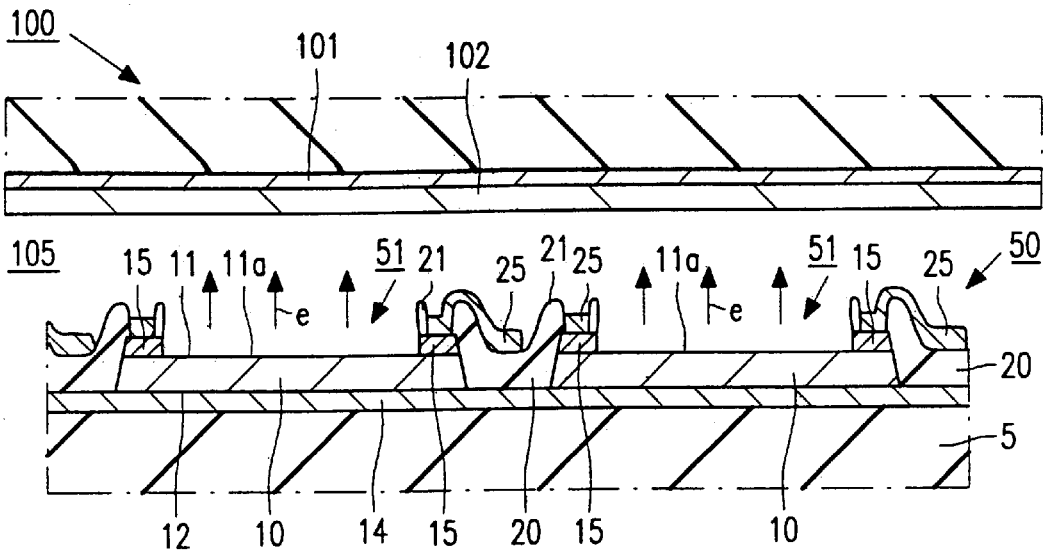
FIG. 1 is a sectional view along the line I—I of FIG. 2, of part of an electron device in accordance with the present invention, including part of a thin-film array of electron emitters.

It should be understood that all the FIGS. 1 to 5 are diagrammatic and not drawn to scale. Relative dimensions and proportions of parts of these Figures have been shown exaggerated or reduced in size for the sake of clarity and convenience in the drawings. The same reference signs are generally used to refer to corresponding or similar features in different embodiments.

DESCRIPTION OF THE PREFERRED EMBODIMENTS

Figure 2:
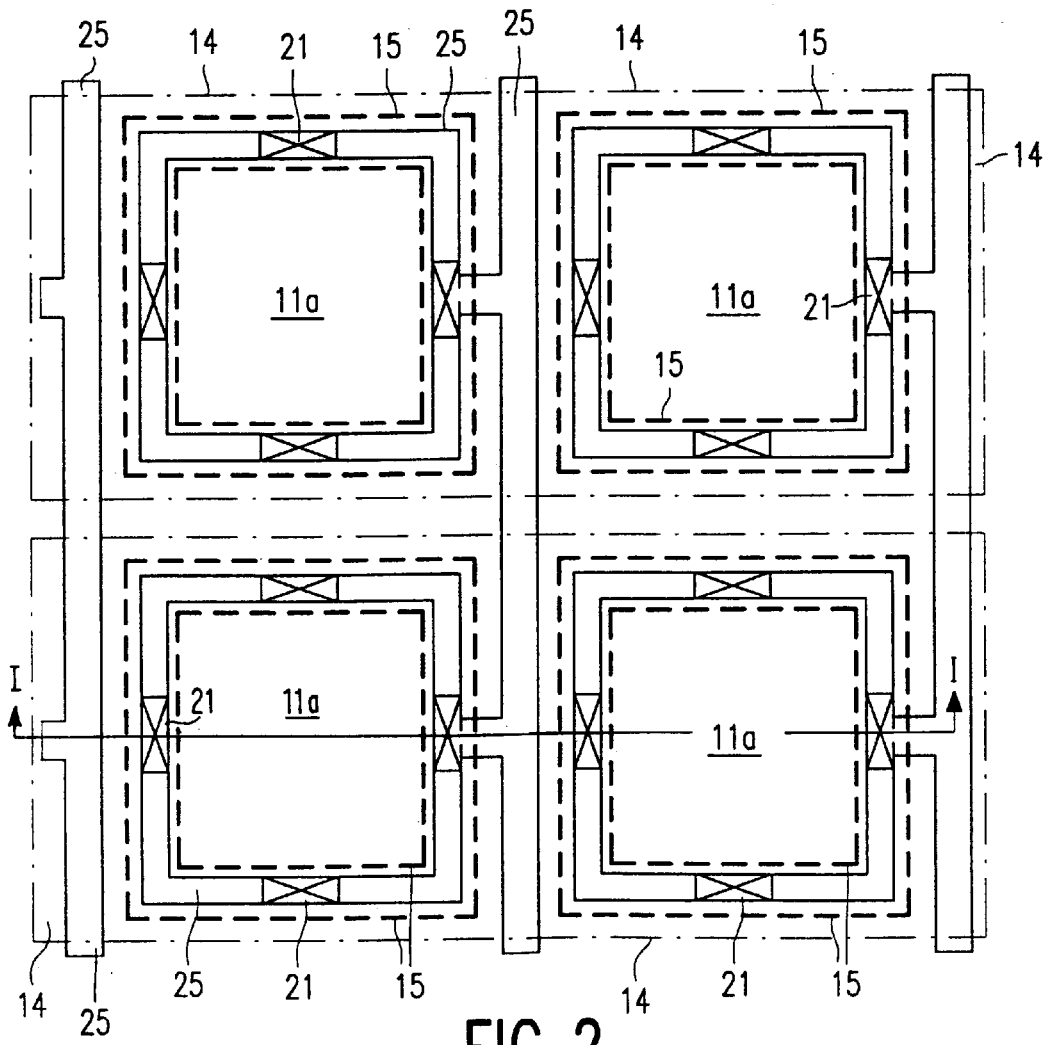
FIG. 2 is a plan view of the electron device of FIG. 1.

FIGS. 1 and 2 illustrate an example of an embodiment of electron device, for example a flat panel display, in accordance with the present invention. Such a display includes an anode plate 100 which is spaced in a vacuum 105 from an electron emitter array 50. The anode plate 100 may be of known form having an electrode layer 101 and a phosphor or other electroluminescent material 102 which is activated by electron emission from the electron emitter array 50. A high positive potential of, for example, about 1 kV is applied to the electrode layer 101 to bias the anode plate 100 with respect to the emitter array 50. The vacuum gap 105 between the anode plate 100 and the emitter array 50 may be, for example, about 50 $\mu$m (micrometers).

The emitter array 50 comprises thin-film electron emitters 51 of a special construction in accordance with the present invention. These emitters 51 are formed side-by-side in a semiconductor film 10 having a front major surface 11 at the front of the emitter and a back major surface 12 at the back of the emitter. Semiconductor film 10 is present on a substrate 5 of, for example, glass or another insulating material at least adjacent its upper surface.

Each emitter 51 comprises an electron emission area in the form of a plane area 11*a* of the front major surface 11 of the film 10, an injector electrode 14 forming a potential barrier $\phi_B$ with the semiconductor film 10 at the back major surface 12, and a front electrode 15 located beside the plane emission area 11*a*. The emission area 11*a* is free of the front electrode 15 and so unobstructed thereby. This front electrode 15 is electrically connected laterally to the emission area 11*a*, for example by a direct electrical contact of the electrode 15 with the edge of the emission area 11*a* in the example of FIGS. 1 and 2.

Semiconductor film 10 has a sufficiently small thickness and low doping (possibly even no doping) across its thickness from the injector electrode 14 to the emission area 11*a* as to support a depletion layer establishing a field from the injector electrode 14 to the emission area 11*a* (see FIG. 3) in operation of the emitter when the front electrode 15 is biased sufficiently positively with respect to the injector electrode 14 for injecting a current $J_e$ of electrons e from the injector electrode 14 into the semiconductor film 10. This field heats the electrons e and directs them towards the emission area 11*a* at the front major surface 11. The positive bias $V_{15}$ between the front electrode 15 and the injector electrode 14 may be achieved by applying a small positive potential (for example up to about 10 or 20 volts) to the front electrode 15 while grounding the injector electrode 14. The potential of the front electrode 15 determines the surface potential at the emission area 11*a* from which electrons e are emitted towards the anode plate 100 in operation of the device. In this way, the front electrode 15 controls the magnitude of an electron accumulation layer Ne in the semiconductor film 10 at the emission area 11*a* and also serves to extract excess electrons not emitted from the emission area 11*a*.

Preferably the semiconductor film 10 is of a thin-film silicon material with which barrier heights and contact resistances can be precisely defined for the respective injector electrode 14 and the respective front electrode 15. In a particular example the film 10 may be of hydrogenated amorphous silicon and may be deposited by, for example, a known chemical vapour deposition (CVD) process such as is used in thin-film silicon technology. Alternatively, the film 10 may be of a non-stoichiometric silicon-rich silicon compound or alloy, for example hydrogenated amorphous $SiC_x$, $SiN_y$, $SiO_xN_y$. The film 10 may be deposited to a thickness of about 0.1 $\mu$m or larger, for example 0.5 $\mu$m. The required operating voltage between the injector electrode 14 and the front electrode 15 increases with increasing film thickness.

The injector electrode 14 may be formed conveniently of chromium. Chromium forms a barrier $\phi_B$ of about 0.85 eV with undoped CVD amorphous silicon and a higher barrier with the amorphous non-stoichiometric silicon compounds and alloys. The silicon material of the film 10 may be substantially undoped except where an ohmic contact is provided by the front electrode 15. The front electrode 15 is most conveniently formed as an n-type semiconductor region having a high arsenic or phosphorous doping concentration. This doping concentration may be introduced into the area of the silicon film 10 beside the emission area 11*a*, for example by ion implantation. Alternatively, the doped semiconductor region for the front electrode 15 may be deposited on an area of the film 10 beside the emission area 11*a*. The doped surface electrode 15 may extend around the whole perimeter of the emission area 11*a*. Connections to the doped surface electrodes 15 of the emitters 51 of the array 50 may be formed by conductive tracks 25 (for example of a metal such as molybdenum) which contact the electrodes 15, for example at windows 21 in an insulating film 20 (for example of stoichiometric insulating silicon nitride) on areas of the semiconductor film 10. The insulating film 20 is absent from the emission areas 11*a* of the film 10, so as not to inhibit electron emission from these areas 11*a*. The tracks 25 extend over the insulating film 20.

In the particular example illustrated in FIGS. 1 and 2, the array 50 of electron emitters 51 is organised as a two-dimensional matrix on the substrate 5. One plurality of thin-film metal tracks 14 extends along one direction on the substrate 5 to form the injector electrodes 14 of the emitters 51. Another plurality of conductive tracks 25 extends along the front major surface 1 1 of the semiconductor film 10 and transverse to the one direction to form connections to the front electrodes 15 of the emitters 51. The tracks which form the injector electrodes 14 may be typically about 100 $\mu$m wide and form row conductors of the matrix. The emission areas 11*a* may typically have transverse dimensions of about 60 $\mu$m to 80 $\mu$m. The tracks which form the connections 25 to the front electrodes 15 extend across the matrix as column conductors which may have a width of between 10 $\mu$m and 20 $\mu$m, for example. Preferably parts of these tracks 25 (for example, with a narrower width than the column conductors) extend around most of the perimeter of the emission area 51, in contact with the front electrode 15 either in an annular window 21 around the whole perimeter or via local windows 21 in the insulating film 20. By way of example, FIG. 2 illustrates four local windows 21, one window 21 on each of the four sides of the emission area 11*a* of FIG. 2. In the particular example illustrated in FIG. 1, the semiconductor film 10 is divided into separate islands. Each island may comprise a single emitter 51 or a column of emitters 51. However, when a sufficiently thick insulating film 20 is provided between emitters 51, the array 50 may be formed with a continuous semiconductor film 10.

Figure 3:
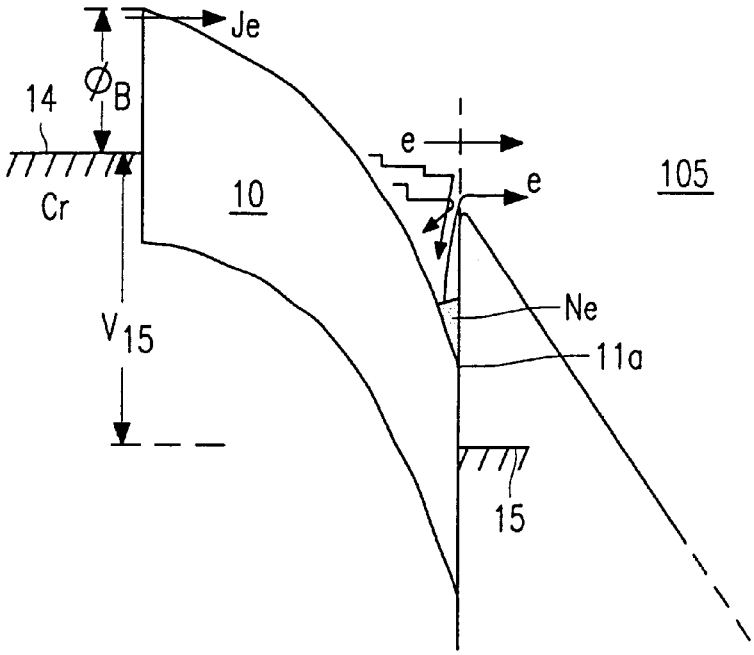
FIG. 3 is an energy band diagram through an emitter of FIGS. 1 and 2 when biased for the emission of electrons.
Figure 4:
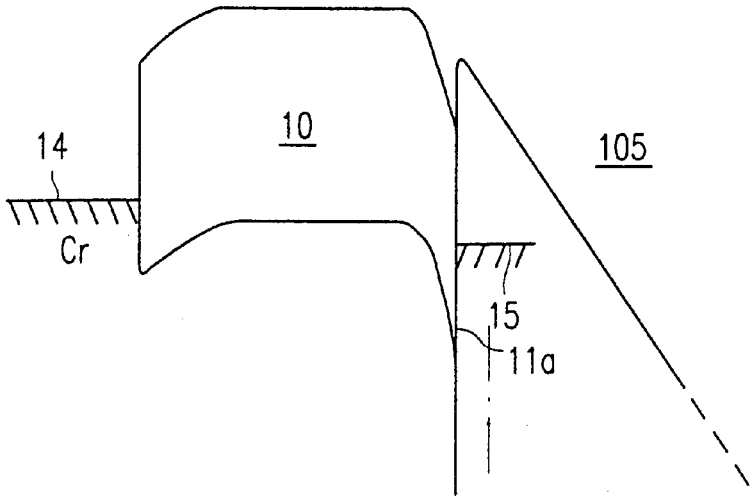
FIG. 4 is an energy level diagram through the emitter of FIG. 3 when only weakly biased, i.e when not producing electron emission.

The operation of the array 50 of emitters 51 will now be described with reference to FIGS. 3 and 4. FIG. 3 illustrates the situation in which a particular emitter 51 is in the on state, and so it is emitting electrons e from its emission area 11*a* of the front major surface 11. FIG. 4 illustrates the situation in which a particular emitter 51 is in its off state, and so no electrons e are emitted from its emission area 11*a*. The operational difference between FIGS. 3 and 4 is determined by the difference in potential of the front electrode 15 as compared with the injector 14. The barrier $\phi_B$ present between the injector electrode 14 and the semiconductor film 10 prevents the injection of a current Je of electrons into the film 10 until a sufficiently large field is applied between the injector electrode 14 and the front electrode 15 to deplete the undoped region of the film 10 (between the injector electrode 14 and the emission area 11*a*) and to overcome the barrier $\phi_B$. This field results from the application of the voltage $V_{15}$ in FIG. 3 to the front electrode 14, while the injector electrode 14 is maintained at, for example, ground potential. The voltage $V_{15}$ varies in accordance with the data input to the emitter 51. Thus, $V_{15}$ comprises a data signal component (i.e the video signal in the case of a display) carried as a variation on a positive potential level. In a particular example, the voltage $V_{15}$ may be in the range of 15 volts to 20 volts, the 15 volts corresponding to the minimum data level (i.e black level in a display) and the 20 volts corresponding to the maximum data level. The minimum data level voltage $V_{15}$ is not quite sufficient for depleting the film 10 and for the electrons to overcome the barrier $\phi_B$.

FIG. 4 illustrates the situation where $V_{15}$ is above the minimum level sufficient to inject a current Je of electrons e into the depleted film 10. The electrons e from the injector electrode 14 are heated as they traverse the depleted region of the film 10 to the emission area 11*a*, where some of these electrons e have sufficient energy to be emitted from the area 11*a*. However, a significant percentage of the hot electron population from the injector electrode 14 will have insufficient energy to be directly emitted on arrival at the front major surface 11. An accumulation of electrons occurs adjacent to the emission area 11*a*. The high positive potential on the anode plate 100 assists in inducing this electron accumulation. The resulting electron inversion layer at the surface 11*a* is designated by Ne in FIG. 3. The accumulation of electrons at the surface 11*a* and the onset of electron emission from the surface 11*a* may also be affected by leakage paths in the semiconductor film 10. One such leakage path mechanism may be via defect band conduction as disclosed for silicon material films in "Current-Induced Defect Conductivity in Hydrogenated Silicon-Rich Amorphous Silicon Nitride" by Shannon et al, Philosophical Magazine Letters 1995, Vol 72, No 5, pp 323–329. Creation of these leakage paths in the film 10 can allow electron accumulation to occur at the surface area 11*a* at lower fields than would otherwise be needed.

Because the front electrode 15 determines the surface potential at the emission area 11*a*, the potential $V_{15}$ on the front electrode 15 has a major effect in determining the population and control of the electron layer Ne. Although individual electrons in the electron layer Ne have insufficient energy in themselves for emission, they can be heated into a sufficiently high energy state for emission by the energy loss from hot electrons which arrive from the injector 15 and which become trapped in the potential well of the accumulation layer at the surface area 11*a*. The resulting emission mechanism has some similarities to the hot electron model proposed by Bayliss and Latham for insulators, in reference 17 of the Applied Physics Letters paper cited above. The Bayliss and Latham model arose from an analysis of field-induced hot-electron emission from metal-insulator microstructures on broad-area high-voltage electrodes. The insulator microstructures were anomalous particles or inclusions on the metal cathode surface, and not any deliberately fabricated structure. The present invention has several important differences, namely a semiconductor film 10 which has such a thickness and doping concentration (or substantially no doping concentration) as to be depleted between the injector electrode 14 and the emission area 11*a*, and a front electrode 15 which is in electrical contact with the front major surface 11 of the semiconductor film 10 to determine the surface potential at the emission area 11*a* and thereby to control the magnitude of the electron accumulation layer Ne and to extract excess electrons not emitted from the emission area 11*a*. The front electrode 15 of the present invention provides a means for biasing the emission area 11*a* at a sufficiently positive potential with respect to the injector electrode 14 as to allow a data signal to control the injection of electrons e over the barrier $\phi_B$ into the semiconductor film 10 in operation of the emitter. Furthermore, the front electrode 15 permits an emitter 51 to be turned off as illustrated in FIG. 4.

The emitter array 50 of FIGS. 1 and 2 is a two-dimensional matrix, having rows corresponding to the separate parallel injector electrode tracks 14 and columns corresponding to the separate parallel conductors 25 of the front electrodes 15. There are two situations in which a particular emitter 51 requires to be kept off. In the first situation the particular emitter 51 is in an addressed row and in the column to which the data signal is applied, but the signal $V_{15}$ applied to this particular emitter 51 is at the minimum data level which is insufficient for depleting the film 10 and heating the electrons in the injector electrode 14 to overcome the barrier $\phi_B$. The injector electrode 14 of this particular emitter 51 in this addressed row is at the same potential as would be the case for a turned-on emitter 51, for example, ground potential. In the second situation the particular emitter is in the column to which the data signal is applied but is in a non-addressed row. In this case, a positive voltage (for example of about 10 volts) may be applied to the injector electrode 14 so as to ensure that the potential difference between the injector electrode 14 and the front electrode 15 is insufficient to deplete the film 10 in this emitter region and so also insufficient to heat the electrons sufficiently in the injector electrode 14 to overcome the barrier $\phi_B$. Thus, for example, the injector electrodes 14 of non-addressed rows may be held at a positive potential below the minimum positive potential applied to the front electrodes 15, whereas the injector electrodes 14 of an addressed row may be held at, for example, ground potential. This situation is illustrated in FIG. 4 where the potential difference between the front electrode 15 and the injector electrode 14 of the respective emitter 51 is below the operational minimum. In this case, the semiconductor film 10 in the area between the injector electrode 14 and the front electrode 15 is not depleted, and the barrier $\phi_B$ prevents the injection of electrons from the injector electrode 14 into the semiconductor film 10. No emission therefore occurs from the area 11*a* of this emitter 51. Thus, the emitters 51 can be switched on and off by switching the voltages applied to the front electrode 15 and the injector electrode 14.

In order to facilitate further the emission of electrons from the emission area 11*a*, an n-type surface doping concentration may be included advantageously in the undoped hydrogenated amorphous silicon material at the region where the electron accumulation layer Ne occurs. This surface doping at the emission area 11*a* serves to adjust the magnitude of the accumulation layer Ne relative to the front electrode 15, and hence to adjust the electron threshold at the surface 11. Such a control of the electron threshold is readily obtained using known thin-film silicon technology, for example by a low-energy implant of arsenic ions or antimony ions.

Many modifications and variations are possible in accordance with the present invention. Thus, for example, the semiconductor film 10 need not be of uniform composition. At the back surface 12 the film 10 may be of a non-stoichiometric silicon-rich silicon compound material (for example $SiN_y$) to provide a higher barrier $\phi_B$ with the injector electrode 14. The composition of this film 10 may then vary from hydrogenated amorphous $SiN_y$ at the back surface 12 to hydrogenated amorphous Si at the front surface 11. A good ohmic contact can be formed between the front electrode 15 and this silicon surface 11. The compositional variation across the thickness of the film 10 can be achieved by varying the gas composition from which the film 10 is deposited using known chemical vapour deposition techniques.

Figure 5:
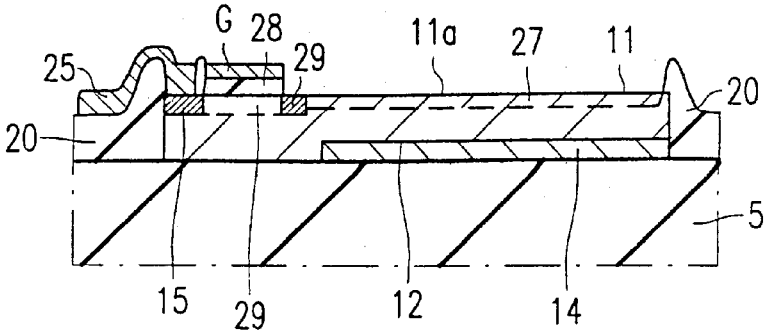
FIG. 5 is a cross-sectional view through part of a thin-film electron emitter in a modified form, also in accordance with the present invention.

FIG. 5 illustrates a modified emitter 51 in which an additional electrode connection G is provided to form an insulated gate between the front electrode 15 and the emission area 11*a*. An n-type surface doping 27 is included at the area 11*a* to adjust the electron threshold for emission. The arrangement at the front surface 11 is similar to a thin-film field-effect transistor (TFT) structure, in which a thinner insulating film 28 provides a gate dielectric below the gate electrode G. The doped surface electrode 15 and the surface doping 27 at the emission area 11*a* behave as source and drain of this TFT structure. In this case, the front electrode 15 may be connected to a constant positive potential for electron emission. At the back surface 12, the area of the injector electrode 14 is now restricted to the area underlying (i.e opposite) the emission area 11*a*, i.e the injector electrode 14 does not extend below the front electrode 15 or below the insulated gate structure G,28. By applying a suitable gate potential to the gate electrode G, a conductive channel 29 can be formed in the area of the film 10 between the front electrode 15 and the emission area 11*a*. In this manner it is possible to gate the setting of the surface potential of the emission area 11*a*. The potential on the gate G can therefore determine to which emission areas 11*a* depletion layers punch through from the injector electrode 14, and hence can determine which emitters 51 are turned on or off. Furthermore, the gate G serves also to gate the extraction by the front electrode 15 of electrons not emitted from the emission area 11*a*. In the case of an array of FIG. 5 emitters, the gates G are connected to the column tracks to which the varying data input is applied. In order to provide a well-defined edge-connection between the induced conductive channel 29 and an electron accumulation layer Ne at the emission area 11*a*, a local n-type doped region 29*a* may be formed between these areas 11*a* and 29 in the same doping step as forms the doped surface electrode 15. Alternatively a moderately high doping concentration 27 may be provided over the whole emission area 11*a*.

Figure 6:
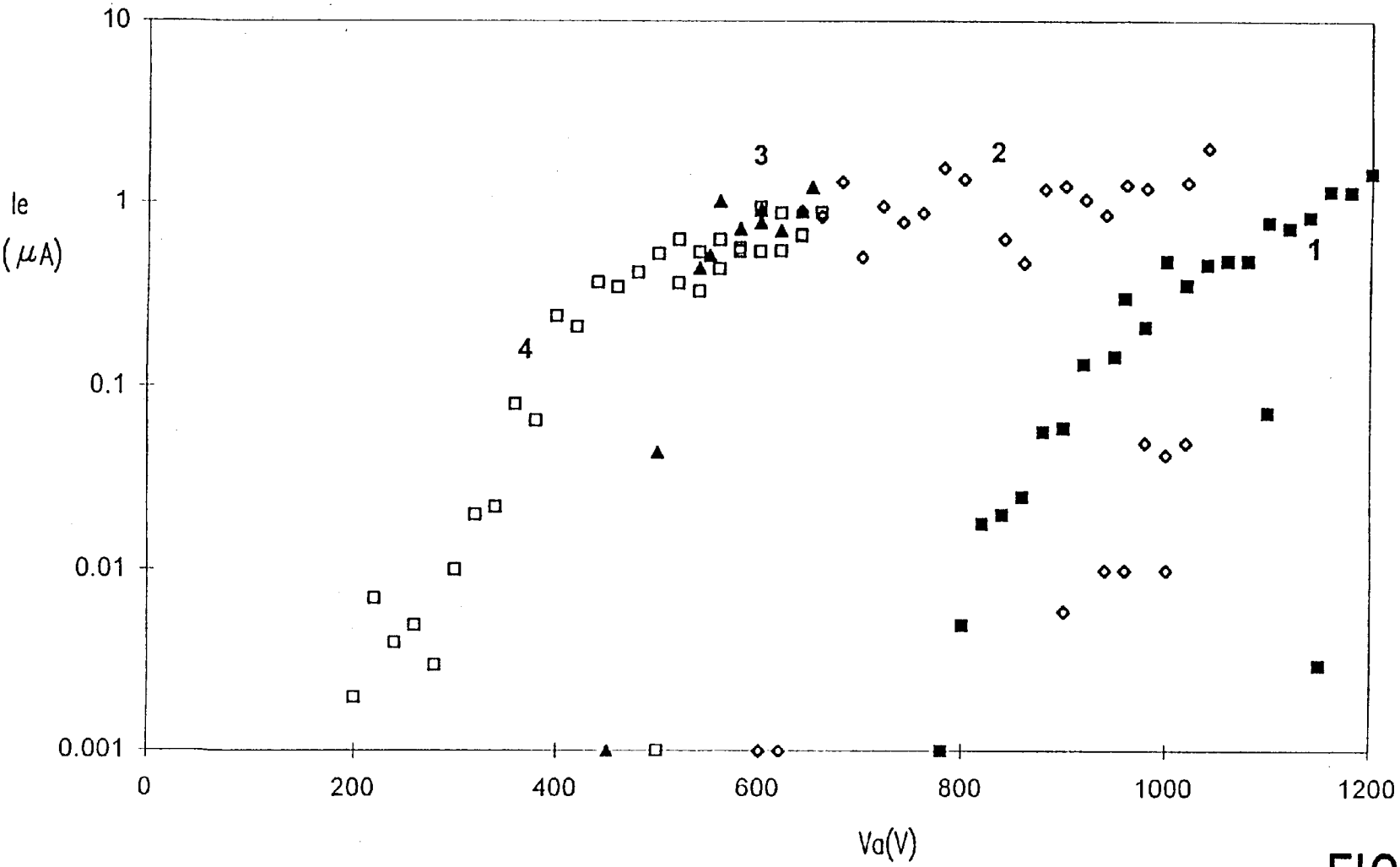
FIG. 6 is a graph showing the variation of emission current le in $\mu$A (microAmps) versus the applied anode voltage Va in V (volts) for a stressed a-Si:H film emitter.
Figure 7:
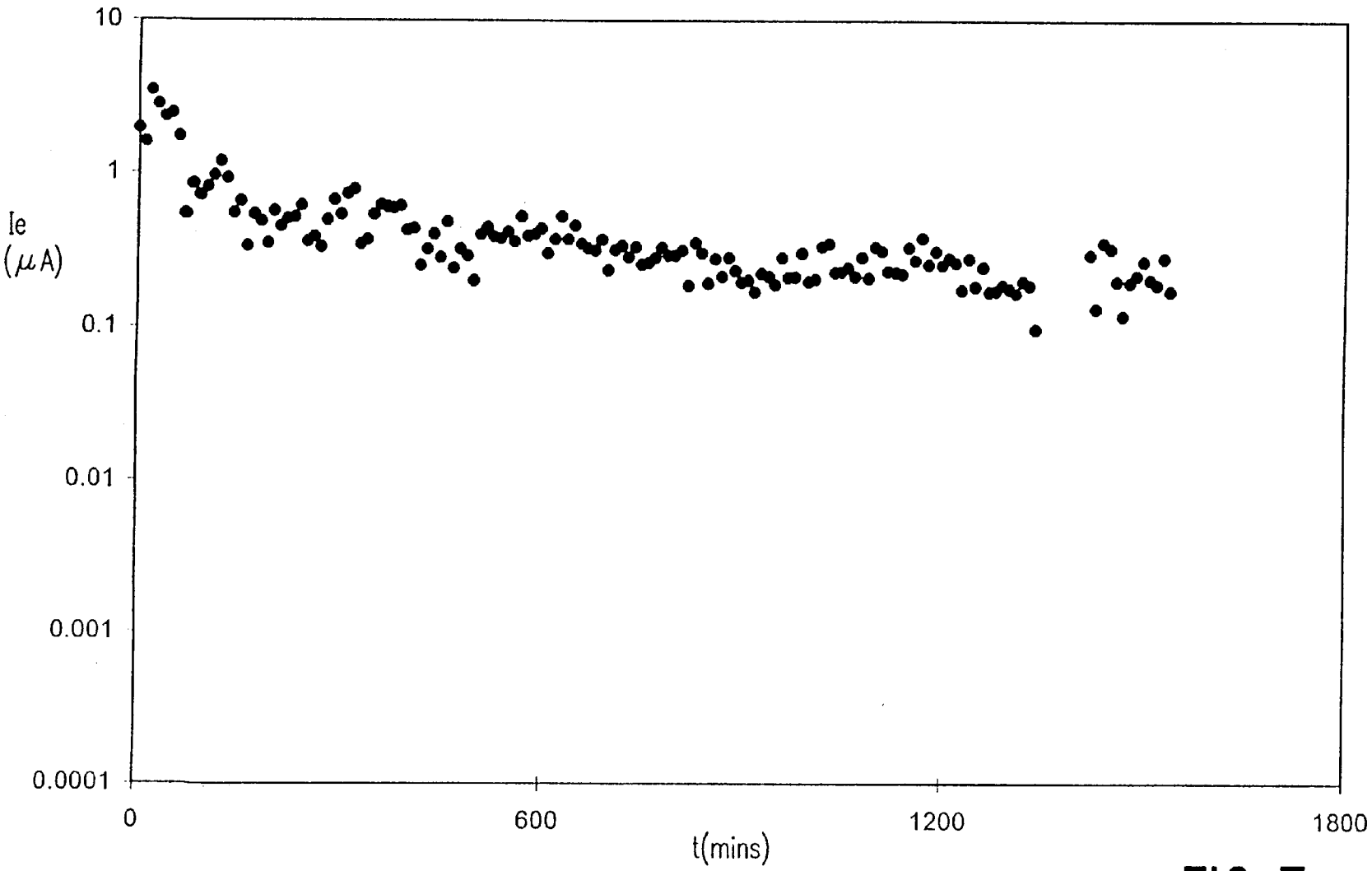
FIG. 7 is a graph showing the small variation of emission current le in $\mu$A (microAmps) with operation time t in mins (minutes) during a continuous lifetime test of an emitter of FIG. 6.

FIGS. 6 and 7 illustrate emission currents which have been obtained by the present inventors with hydrogenated amorphous silicon (a-Si:H) films 10 deposited by a standard PECVD (plasma enhanced chemical vapour deposition) process at 250° C. at a growth rate of 25 nm.min$^{-1}$ and using feed gases of $SiH_4$ and $H_2$. The resulting films contained approximately 10 atomic percent of hydrogen. Although no dopant was incorporated, the films were slightly n-type with mid-gap defect state densities of the order of $10^{16}$ cm$^{-3}$. The films 10 deposited to a thickness of 100 nm (nanometer) on a 50 nm thick Cr injector electrode 14 were smooth and of device quality similar to that used to produce switching TFTs in AMLCDs (active-matrix liquid-crystal displays).

The electron field emission measurements were performed on a parallel plate configuration with a fixed anode-emitter gap 105 of 50 $\mu$m. A simple anode plate 100 in the form of an ITO (indium tin oxide) coated glass plate was used for these measurements. The gap 105 was maintained by means of PTFE and glass-fibre spacers between the thin-film emitter and the plate 100. All field emission measurements were performed at a vacuum of $3\times10^{-6}$ mbar or better, with the emitters being checked for reverse leakage current after every cycle of measurement. Reverse leakage currents were less than the minimum detectable limit of $1\times10^{-9}$ A for the measurement system used. Each measurement of emission current le plotted in FIGS. 6 and 7 is the average of 10 single measurements at a fixed bias, with a fixed delay period of 2 seconds between readings. The bias voltage was ramped slowly to the next value after a delay of 60 seconds.

The inventors find that, by stressing the a-Si:H films, the voltage required for the emission of electrons e can be reduced by a factor of approximately two. Stressing is achieved by applying a high electric field across the a-Si:H film for a prolonged period of time. Before stressing, there were no discernible features or texture to the a-Si:H film under a SEM (scanning electron microscope). After stressing, small features less than 500 nm in size and with no sharp edges were observed with the SEM. The results given in FIGS. 6 and 7 are for stressed films.

Furthermore the measurements of FIG. 6 show that it is advantageous to condition the stressed a-Si:H film in manufacture before its use in the final device. Conditioning is achieved by carrying out at least four prior emission-operating runs with the stressed a-Si:H emitter. In the results of emission current le versus applied anode voltage Va which are displayed in FIG. 6, the number 1 to 4 next to the different plots (1 with solid-square points; 2 with diamond points; 3 with triangular points; and 4 with outline-square points) indicates the emission run on which that measurement was made. Thus, FIG. 6 shows that conditioning of these a-Si:H emitters is required in order to give stable and reproducible emission from a plane a-Si:H emission area. Once the emitter has been conditioned, emission remains stable at the same lower limiting value to which the emission tends on run 4. Repeated measurements subsequently on the conditioned emitter resulted in identical characteristics. There is also a large hysteresis observed in run 1 which decreases with the subsequent measurement cycles 2 to 4.

FIG. 7 shows the results of le measurements during a lifetime test for one such typical (stressed and conditioned) a-Si:H emitter, operated continuously over a time t of 25 hours (1500 mins). A continuous emission current le (with no reverse leakage) was obtained over this time of 25 hours. The experiment was terminated after the 25 hours which can be equated to operating the emitter for over 25,000 hours in a video display device having a matrix line addressed picture with a frame time of 20 msec.

In the embodiments described so far with reference to FIGS. 1 to 5, the injector barrier was formed by a metal-semiconductor heterojunction between a metal electrode film 14 and the semiconductor film 10. However, the injector electrode 14 may be formed in other ways, especially when using established silicon technology for the emitters 51. Thus, when the semiconductor film 10 is of a thin-film silicon material the injector electrode 14 may be formed as a doped region forming a reverse-biased p-n junction with the bulk of the film 10 adjacent the surface 12.

Although the present invention is particularly advantageous and well suited to the use of silicon-based thin-film technology, electron emitter structures in accordance with the present invention may be fabricated with semiconductor films 10 of other materials, for example amorphous carbon as described in the Applied Physics Letters paper cited above, or polycrystalline diamond, or an amorphous III-V semiconductor material such as gallium nitride. It is more difficult to provide good barriers $\phi_B$ to amorphous carbon for the injector electrode 14, whereas it is easy to form good ohmic contacts for the front electrode 15. It is more difficult to provide good ohmic contacts to polycrystalline diamond for the front electrode 15. Therefore silicon-based technology is currently preferred over these other semiconductor material technologies, especially as established TFT silicon technology can be used.

FIG. 1 illustrates, by way of example, a conventional display anode arrangement with a vacuum gap 105 between the emitter array 50 and an anode plate 100. However, a display may be made by depositing electroluminescent material 102 on the emitter array 50 and depositing the anode electrode layer 101 on the electroluminescent material 102. By incorporating a thin-film emitter array 50 as described above, such a display including an anode but no vacuum gap 105 may be constructed in accordance with the present invention. The thin-film emitter arrays 50 in accordance with the present invention may also be used in other types of electron device for example microwave or other high frequency vacuum devices as mentioned in the IEEE Electron Device Letters paper.

From reading the present disclosure, other modifications and variations will be apparent to persons skilled in the art. Such modifications and variations may involve equivalent features and other features which are already known in the art and which may be used instead of or in addition to features already disclosed herein. Although claims have been formulated in this Application to particular combinations of features, it should be understood that the scope of the disclosure of the present application includes any and every novel feature or any novel combination of features disclosed herein either explicitly or implicitly and any generalisation thereof, whether or not it relates to the same invention as presently claimed in any Claim and whether or not it mitigates any or all of the same technical problems as does the present invention. The Applicants hereby give notice that new claims may be formulated to such features and/or combinations of such features during prosecution of the present application or of any further application derived therefrom.

We claim:

1. An electron device including a thin-film electron emitter comprising a semiconductor film, the emitter having an emission area comprising a plane area of a front major surface of the semiconductor film from which hot electrons are emitted in operation of the emitter, an injector electrode at a back major surface of the semiconductor film from which electrons are injected into the semiconductor film, electron-accumulation means for providing an accumulation layer of electrons at the emission area of the semiconductor film, and a front electrode located beside the emission area and electrically connected laterally to the electron accumulation layer to determine the surface potential at the emission area for controlling the magnitude of electron accumulation at the emission area and for extracting excess electrons not emitted from the emission area, the emission area being free of the front electrode, and the semiconductor film having such a thickness as to support a depletion layer from the injector electrode to the electron accumulation layer when the emission area is biased by the front electrode sufficiently positively with respect to the injector electrode for injecting the electrons from the injector electrode into the semiconductor film in operation of the emitter, the depletion layer establishing from the injector electrode to the emission area an electric field in which the electrons are heated and directed towards the emission area.

2. An electron device as claimed in claim 1, wherein an array of said thin-film electron emitters are formed side-by-side in the semiconductor film.

3. An electron device as claimed in claim 2, wherein the array of electron emitters is organised as a 2-dimensional matrix on a substrate, a plurality of thin-film metal tracks extends along one direction on the substrate to form the injector electrodes of the emitters, and a plurality of conductive tracks extends along the front major surface of the semiconductor film and transverse to the one direction to form connections for the front electrodes of the emitters.

4. An electron device as claimed in claim 3, wherein the conductive tracks at the front major surface comprise the front electrodes and are connected to an edge of the electron accumulation layers of the respective emitters.

5. An electron device as claimed in claim 3, wherein the connections for the front electrodes of the emitters are in the form of an insulated gate provided on the semiconductor film between the front electrode and the emission area to gate the electrical connection between the front electrode and the electron accumulation layer.

6. An electron device as claimed in claim 1 wherein the front electrode extends around at least most of the perimeter of the emission area.

7. An electron device as claimed in claim 1 wherein the semiconductor film is of a hydrogenated amorphous and/or microcrystalline silicon material from the group of $SiC_x$, $SiN_y$, $SiO_xN_y$, and Si.

8. An electron device as claimed in claim 7, wherein the hydrogenated amorphous and/or microcrystalline silicon material is substantially undoped with any conductivity type determining doping concentration, at least between the injector electrode and a region where the electron accumulation layer occurs at the emission area.

9. An electron device as claimed in claim 8, wherein an n-type surface doping concentration is included in the region where the electron accumulation layer occurs to adjust the electron threshold at the surface of the emission area.

10. An electron device as claimed in claim 1, in the form of a display including the thin-film electron emitter and also an anode plate which has an electroluminescent layer activated by electron emission from the electron emitter.

* * * * *